US006257962B1

(12) United States Patent
Franke et al.

(10) Patent No.: US 6,257,962 B1
(45) Date of Patent: Jul. 10, 2001

(54) APPARATUS AND METHODS FOR FORMING HOLLOW-GROUND KNIFE BLADES

(76) Inventors: Norman T. Franke, 306 S. Third St.; Steven N Cissell, 7331 Loretto Rd., both of Bardstown, KY (US) 40004

( * ) Notice: Subject to any disclaimer, the term of this patent is extended or adjusted under 35 U.S.C. 154(b) by 0 days.

(21) Appl. No.: 09/390,367

(22) Filed: Sep. 7, 1999

(51) Int. Cl.[7] ..... B24B 21/12
(52) U.S. Cl. ..... 451/45; 405/182; 405/302
(58) Field of Search ..... 451/182, 192, 451/194, 208, 45, 302

(56) References Cited

U.S. PATENT DOCUMENTS 3,543,446 * 12/1970 Kilian ..... 451/194
4,617,763 * 10/1986 Edling ..... 451/302
4,671,018 * 6/1987 Ekhoff ..... 451/302 X
4,676,029 * 6/1987 Palmer ..... 451/302 X
5,012,618 * 5/1991 Price et al. ..... 451/302 X
5,099,615 * 3/1992 Ruble et al. ..... 451/302 X
5,651,722 * 7/1997 Werner ..... 451/302 X
5,888,123 * 3/1999 Wang ..... 451/302 X

* cited by examiner

*Primary Examiner*—Derris H. Banks
*Assistant Examiner*—Anthony Ojini
(74) *Attorney, Agent, or Firm*—Nixon & Vanderhye

(57) ABSTRACT

Hollow-ground surfaces are simultaneously formed along opposite sides of a knife blade blank by passing the knife blade blank between a pair of grinding wheels. The grinding wheels carry grinding belts about idler pulleys. The idler pulleys are adjustable toward and away from the respective grinding wheels to adjust belt tension and to accommodate different sizes of grinding belts. The angularity of the idler pulleys relative to the grinding wheels is likewise adjustable such that planes passing through the idler wheels and grinding wheels are angularly adjustable relative to one another enabling the grinding belts to run true about the grinding wheels.

12 Claims, 4 Drawing Sheets

Fig. 1
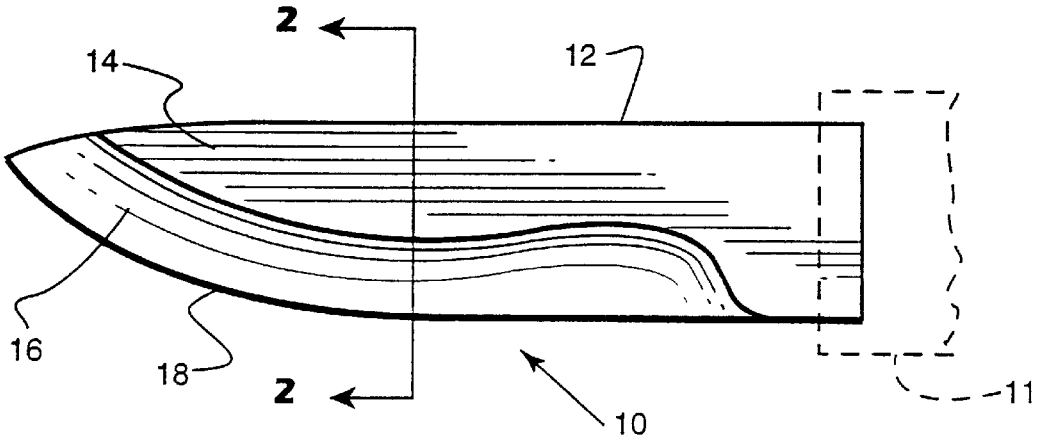
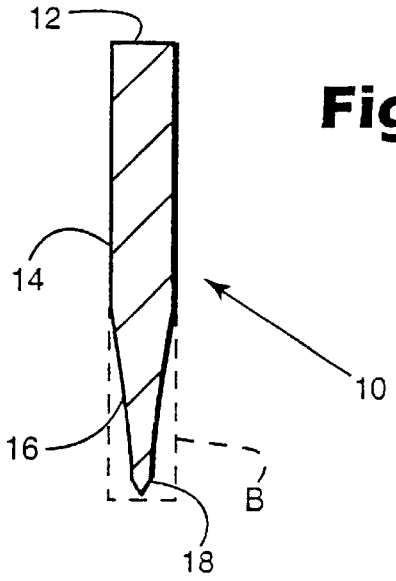
Fig. 2

APPARATUS AND METHODS FOR FORMING HOLLOW-GROUND KNIFE BLADES

TECHNICAL FIELD

The present invention relates to apparatus and methods for forming hollow-ground surfaces simultaneously on opposite sides of a knife blade blank.

BACKGROUND

Knife blade edges are conventionally sharpened by passing the edge of the blade between a pair of grinding wheels. The grinding wheels typically remove metal from the knife blade edge and form tapered surfaces along opposite side edges of the blade to form a sharpened knife blade edge. Knife blade edges are typically sharpened by applying the blade edge to grinding surfaces having various grits, typically from coarse to fine, such that a fine sharp knife blade edge can be formed.

A finished hollow-ground knife blade, however, is characterized by a concave surface on each of the opposite side faces of the knife blade and spaced back from the sharpened edge of the blade. Typically, these hollow-ground side faces are individually manually ground. Thus, hollow-ground knife blades often have non-symmetrical opposite hollow-ground side faces. While care and skill will sometimes result in a near-symmetrical hollow-ground knife blade, each side face of the blade requires substantial individual attention and time which increases the cost of hollow-ground knives. Accordingly, there is a need for a machine for accurately, quickly and simultaneously forming hollow-ground knife blades.

DISCLOSURE OF THE INVENTION

In accordance with a preferred embodiment of the present invention, there is provided a belt grinder in which two grinding belts are employed, enabling opposite side surfaces of a knife to be simultaneously ground thereby forming a hollow-ground knife blade from a knife blank. Particularly, an electric motor drives primary and secondary shafts. Grinding wheels are mounted on the respective shafts and define a gap or nip therebetween. A grinding belt is deployed about each of the grinding wheels and an idler pulley offset to one side of the grinding wheel. The idler pulleys are preferably adjustable toward and away from the associated grinding pulley to adjust the tension of the belts about the grinding pulleys. Also, each idler pulley is angularly adjustable relative to the associated grinding wheel to enable adjustment of the run of the grinding belt to keep it straight and true on the grinding wheel and prevent the belt from riding up over the margins of the grinding wheel and idler pulley.

In a preferred embodiment of the invention, the gap between the grinding wheels is adjustable to accommodate knife blanks of different thicknesses. For example, and in this preferred embodiment, the bearings for one of the shafts and the shaft itself are mounted on a slidable plate. Thus, the bearings, shaft and grinding wheel mounted on the shaft are movable toward and away from the opposing bearings, shaft and grinding wheel into infinitely adjusted positions within that range. By displacing the plate into an adjusted position, the gap between the grinding belts may be adjusted.

In the operation of the foregoing-described machine, a knife blank is disposed in the gap between the grinding wheels. It will be appreciated that the grinding wheels rotate in opposite directions and in an upward direction from the gap. By disposing the knife blank in the gap between the wheels and sliding the blank forwardly and rearwardly, a hollow-ground surface is provided simultaneously on the opposite sides of the knife blank. That is, the simultaneous grinding of the opposite side faces of the knife blank forms the concave side surfaces in the knife blank characteristic of a hollow-ground knife blade and in a manner which is substantially symmetrical about the length of the knife. Also, the hollow-ground faces are spaced or set back from the edge of the knife, which edge, of course, is sharpened after formation of the hollow-ground side faces.

In a preferred embodiment according to the present invention, there is provided a method of forming a hollow-ground knife blade comprising the steps of (a) inserting a knife blade blank into a gap between a pair of rotating grinding wheels and (b) forming concave surfaces simultaneously along opposite side faces of the blank spaced back from an edge of the blank nearest the gap by grinding opposite side faces of the knife blade blank.

In a further preferred embodiment according to the present invention, there is provided apparatus for forming a hollow-ground knife comprising a pair of grinding wheels defining a gap therebetween, a motor for driving the wheels, a pair of idler pulleys, a first endless grinding belt disposed about a first idler pulley of the pair thereof and a first wheel of the pair of grinding wheels, a second endless grinding belt disposed about a idler pulley of the second pair of idler pulleys and a second wheel of the pair of grinding wheels, the first wheel being mounted for movement toward and away from the second wheel to adjust the gap between the wheels and an adjustable element mounting each idler pulley for angular adjustment of the idler pulleys relative to the grinding wheels to adjust the angular relationship of planes passing through the idler pulleys and the grinding wheels.

In a still further preferred embodiment according to the present invention, there is provided apparatus for forming a hollow-ground knife blade comprising a pair of grinding wheels defining a gap therebetween, a motor for driving the wheels, a pair of idler pulleys, a first endless grinding belt disposed about a first idler pulley of the pair thereof and a first wheel of the pair of grinding wheels, a second endless grinding belt disposed about a second idler pulley of the pair of idler pulleys and a second wheel of the pair of grinding wheels, a slide carrying the first grinding wheel and the first idler pulley for movement toward and away from the second wheel and the second idler pulley to adjust the gap between the wheels and a lock for locking the slide in an adjusted position thereby maintaining the gap between the grinding wheels in an adjusted position.

BRIEF DESCRIPTION OF THE DRAWINGS

FIG. 1 is a side elevational view of a hollow-ground knife blade formed in accordance with the present invention;

FIG. 2 is an enlarged cross-sectional view thereof taken generally about on line 2—2 in FIG. 1;

BEST MODE FOR CARRYING OUT THE INVENTION

Figure 3:
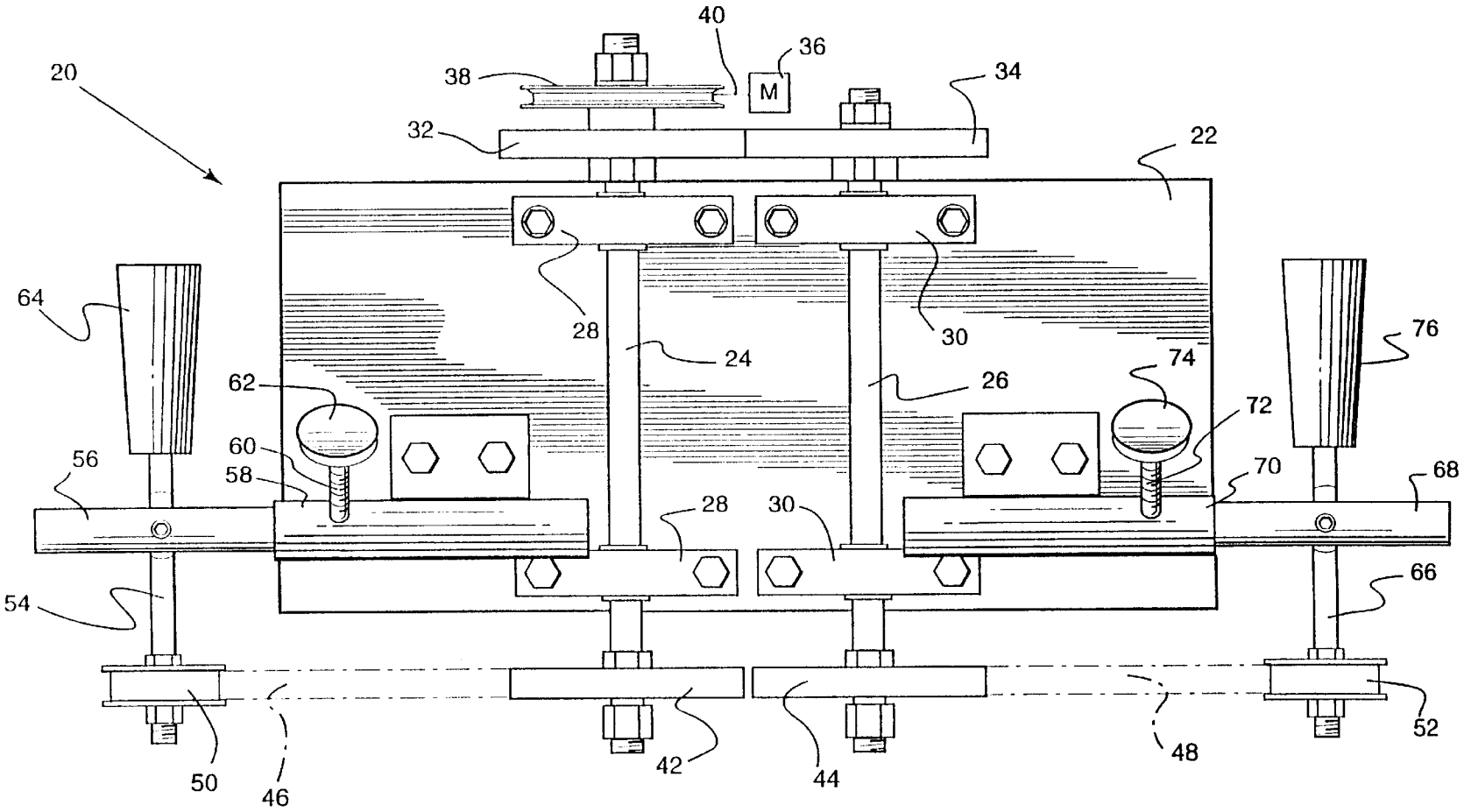
FIG. 3 is a plan view of a machine for simultaneously forming hollow-ground surfaces along opposite side faces of the knife blade blank.

Referring now to the drawings, particularly to FIG. 1, there is illustrated a hollow-ground knife 10 formed in accordance with the present invention. Knife 10 includes a handle 11 and a knife blade 12. Blade 12 has opposite side faces 14 which are hollow-ground, as indicated at 16. Also, the knife blade 12 includes a sharpened edge 18. It will be appreciated that the hollow-ground surfaces 16 along opposite faces 14 of the knife blade 12 are concave and are spaced back from the sharpened edge 18 of the knife blade 12.

Figure 4:
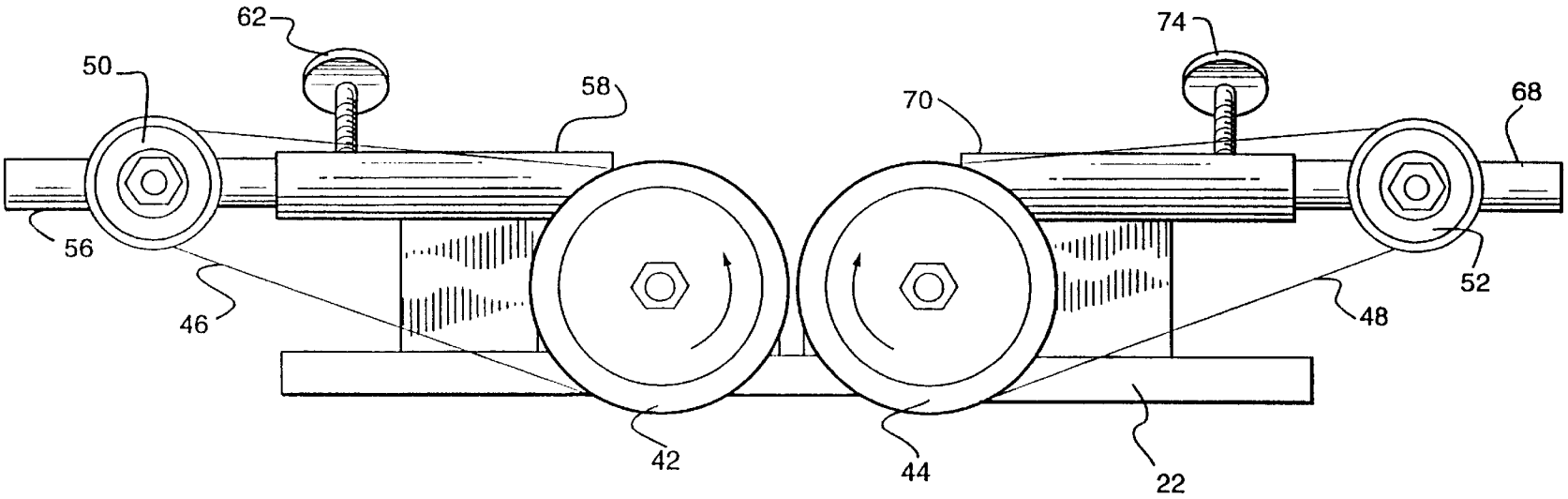
FIG. 4 is a front elevational view thereof.

Referring now to FIGS. 3 and 4, there is illustrated a machine, generally designated 20, for simultaneously forming hollow-ground surfaces in knife blade blanks, for example, the knife blade blank B illustrated by the combined full and dashed line configuration of FIG. 2. Machine 20 includes a base plate 22 mounting a primary driveshaft 24 and a slave driveshaft 26. The driveshafts 24 and 26 are mounted in suitable spaced pairs of pillow block bearings 28 and 30, respectively. The drive and slave shafts 24 and 26, respectively, each mount friction wheels 32 and 34 lying in engagement with one another. A motor 36 is connected to a drive pulley 38 via a drive pulley belt 40. The drive from motor 36 to the primary shaft 24 through pulley 38 causes rotation of the slave shaft 26 in an opposite direction by the engagement of the friction wheels 32 and 34.

A pair of grinding wheels 42 and 44 are mounted on respective ends of the drive and slave shafts 24 and 26 opposite the friction wheels 32 and 34. The grinding wheels 42 and 44 are driven by endless grinding belts 46 and 48, respectively, which extend about respective idler pulleys 50 and 52 spaced from the wheels 32 and 34. Each idler pulley 50 and 52 is mounted for adjustable angular movement relative to the grinding wheels 42 and 44, as well as for movement toward and away from the associated grinding wheel for adjusting belt tension. For example, the idler pulley 50 is rotatably carried on a shaft 54 which extends through an inner slide 56 mounted for sliding movement relative to an outer slide 58. The outer slide 58 is mounted to the base plate 22 and carries a lock-down screw 60 having a knob 62. The screw 60 is threaded into slide 58 to engage inner slide 56 to maintain the inner slide in adjusted longitudinal position relative to the outer slide 58. The shaft 54 also includes a handle 64. The opposite idler pulley 52 is similarly constructed. That is, idler pulley 52 is mounted on a shaft 66 extending through an inner slide 68 mounted in an outer slide 70 secured to the base plate 22. A lock-down screw 72 having a knob 74 is threaded into outer slide 70 to maintain the inner slide 68 in adjusted longitudinal positions relative to the outer slide 70. The shaft 66 also mounts a handle 76.

It will be appreciated that with the foregoing-described arrangement, the idler pulleys 50 and 52 can be adjusted toward and away from the grinding wheels 42 and 44, respectively. Particularly, by displacing, i.e., telescoping, the inner guides 56 and 68 relative to the outer guides 58 and 70, respectively, the idler pulleys 50 and 52 may be adjusted toward and away from the grinding wheels 42 and 44, for example, to adjust the tension in the grinding belts and to accommodate different sized belts. It will also be appreciated that the grinding belts 46 and 48, when in a taut condition and run between the idler and grinding wheels, may sometimes tend to ride up over the margins of the idler or grinding wheels, or both. Angular adjustment of the idler wheels relative to the grinding wheels alleviates that problem and maintains the grinding belts in a true and run condition on the grinding wheels. That is, the idler pulleys are pivotally adjustable relative to planes generally parallel with the planes containing the grinding wheels by incrementally rotationally adjusting shafts 54 and 66 using handles 64 and 76 before the inner slides are locked to the outer slides.

To form a hollow-ground knife blade employing the apparatus disclosed in FIGS. 3 and 4, grinding belts 46 and 48 of appropriate grit are applied to the grinding wheels 42 and 44 and extended about the pulleys 50 and 52. By adjusting the angular and longitudinal position of each of the idler pulleys relative to the associated grinding wheel, the grinding belts can run taut and true along the grinding wheels. Thus, the idler pulleys are moved toward or away from their associated grinding wheels and pivoted relative thereto into adjusted positions as previously described. Once these adjusted positions are obtained, the screws 60 and 72 are locked down to the inner guides 56 and 68, maintaining the idler wheels in adjusted, longitudinal and angular positions. It will be appreciated in the foregoing-described apparatus that the grinding wheels 42 and 44 define a fixed gap therebetween. Thus, the described machine is highly suitable for long production runs of particular knife blanks having a defined thickness whereby substantially similar hollow-ground surfaces may be provided in each of the knife blanks produced. Thus, when all the adjustments are made, the knife blank is disposed in the gap between the grinding wheels 42 and 44 and the grinding belts grind the opposite side faces of the knife blade to simultaneously form the concave surfaces 16. The knife blank is, of course, extended in forward or rearward directions between the grinding wheels to obtain the concave, i.e., hollow-ground surfaces along the length of the knife blank.

Figure 5:
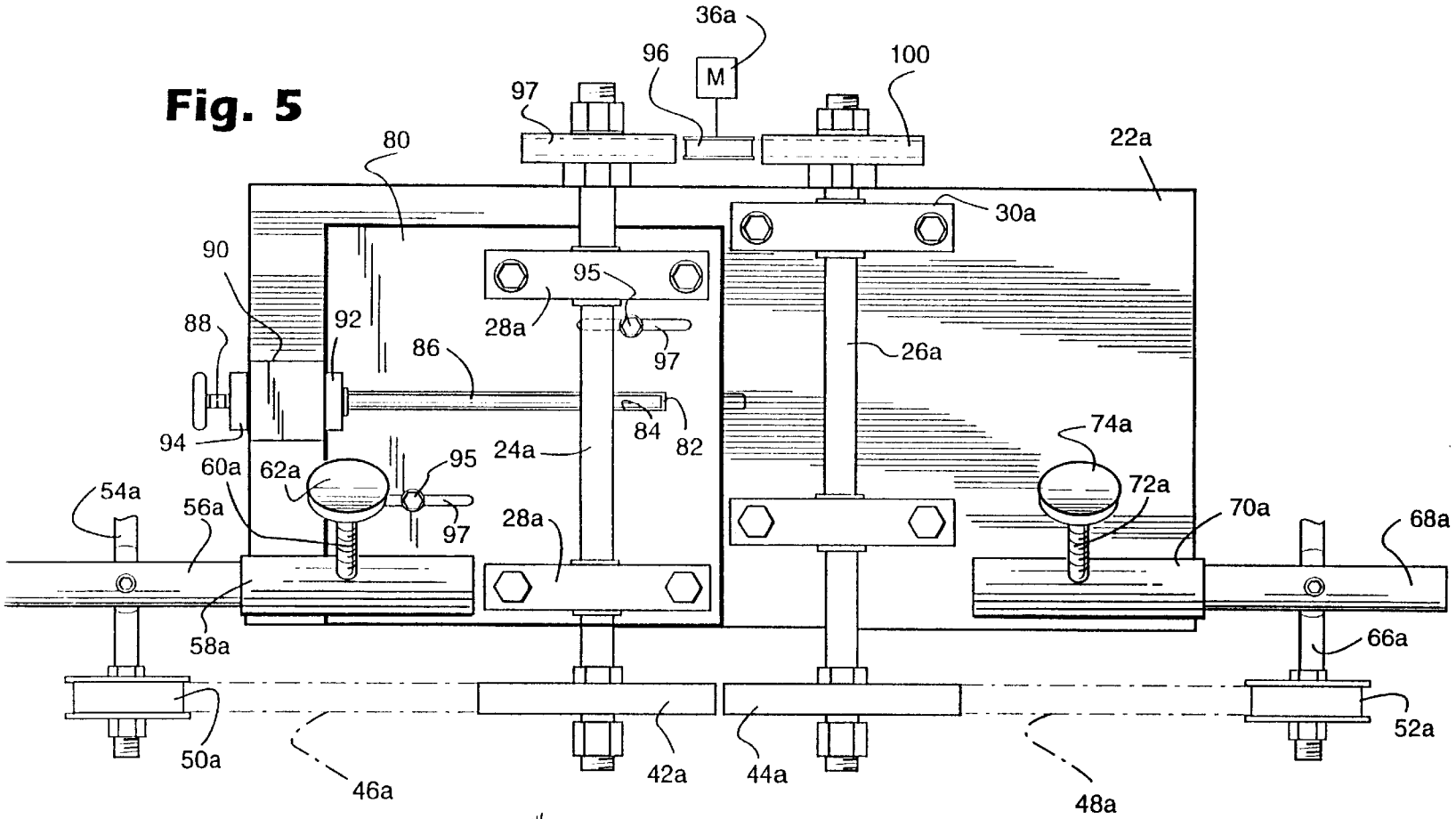
FIG. 5 is a view similar to FIG. 3 illustrating a further form of the present invention.
Figure 6:
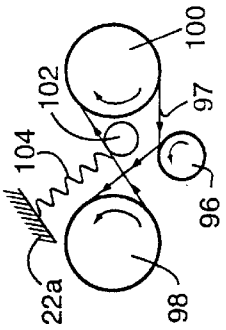
FIG. 6 is a schematic illustration of the drive motor and drive wheels for the grinding wheels hereof.

Referring now to FIGS. 5 and 6, there is illustrated a further embodiment of the present invention wherein the grinding machine is arranged such that the gap between the grinding wheels can be adjusted.

In this embodiment, like reference numerals are applied to like parts as in the previous embodiment, followed by the suffix "a." In this embodiment, the driveshaft 24*a* is mounted on pillow blocks 28*a*, in turn mounted on a slidable plate 80. Plate 80 is slidable relative to the base plate 22*a* in a lateral direction to open and close the gap between the grinding wheels 42*a* and 44*a* by moving one of the grinding wheels toward and away from the other grinding wheel. To accomplish this, the plate 80 is provided with a central slot 82. Underlying slot 82 and in plate 80 is a groove 84 in the base plate 22*a*. A guide bar 86 is disposed in the slot 82 and in the groove 84 to guide the plate 80 for longitudinal sliding movement relative to base plate 22*a* in opposite directions to respectively open or close the gap between the grinding wheels. To displace the slidable plate 80, a screwthreaded pin 88 is threadedly disposed through a block 90 secured on top of the base plate 22*a*. The pin 88 terminates in a bearing 92 mounted on the movable plate 80. By threading or unthreading the pin 88 relative to the block 90, the plate 80 may be displaced in opposite directions. A lock nut 94 is provided for securing the pin in an adjusted position, thus fixing the plate 80 relative to base plate 22*a* and maintaining the gap between the grinding wheels 42*a* and 44*a* in an adjusted position. Lock-down bolts 95 also extend through slots 97 in the plate 80 which, when threaded to plate 22*a*, lock the slidable plate 80 in its adjusted position.

The remaining elements of this embodiment are similar to those described with respect to the embodiment of FIGS. 3 and 4, except for the drive between motor 36*a* and the guiding wheels 42*a* and 44*a*. Referring to FIG. 6, the motor 36*a* drives a pulley 96 which carries an endless belt 97 also disposed about a pair of pulleys 98 and 100. Pulleys 98 and 100 are secured to and drive the primary drive and slave shafts 24*a* and 26*a*, respectively. As illustrated in FIG. 6, the endless belt 97 interconnecting the motor-driven pulley 96 and pulleys 98 and 100 is crossed such that the counterrotating directions of the grinding wheels 42*a* and 44*a* are obtained. Additionally, it will be appreciated that the pulley belt 97 may be maintained taut about the pulley wheels 96, 98 and 100 by a further idler pulley 102 biased by a spring 104 fixed to the machine frame 22*a* to maintain the pulley belt 97 taut.

In operation, the thickness of the gap is determined dependent upon the thickness of the knife blade blank to be hollow-ground. Once the gap is determined, the pin 88 is threaded or unthreaded to displace the slidable plate 80 relative to the base plate 22*a* to provide a gap between the grinding wheels corresponding to the desired gap. As in the previous embodiment, the idler wheels 50*a* and 52*a* are adjusted longitudinally and angularly relative to the grinding wheels 42*a* and 44*a*, respectively. With the gap adjusted to the desired distance between the grinding wheels and the grinding belts 46*a* and 48*a* adjusted to run true by adjusting the angularity of the idler wheels relative to the grinding wheels, the knife blade blank may be disposed in the gap between the grinding wheels. By displacing the knife blade blank forwardly and rearwardly between the grinding wheels, the desired concave surfaces may be ground simultaneously in the opposite side faces of the blank. An edge 18 may then be subsequently formed on the hollow-ground knife by extending the blade through a knife sharpener.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for forming a hollow-ground knife blade comprising:

a pair of grinding wheels;

a motor for driving the wheels;

a pair of idler pulleys;

a first endless grinding belt disposed about a first idler pulley of said pair thereof and a first wheel of said pair of grinding wheels;

a second endless grinding belt disposed about a second idler pulley of said pair of idler pulleys and a second wheel of said pair of grinding wheels;

said grinding wheels being driven by said motor for rotation about parallel axes and in opposite directions;

said grinding wheels and said belts disposed thereabout defining a gap therebetween for simultaneous bearing engagement of said grinding belts against respective opposite sides of a knife as the knife is passed back and forth in a direction generally parallel to said axes to form a hollow ground knife blade;

said first wheel being mounted for movement toward and away from said second wheel to adjust said gap; and an adjustable element mounting each said idler pulley for angular adjustment of the idler pulleys relative to said grinding wheels to adjust the angular relationship of planes passing through the idler pulleys and the grinding wheels.

2. Apparatus according to claim 1 including a slide carrying said first wheel, said first idler pulley and said grinding wheel and a lock for locking said slide in an adjusted position thereby maintaining the gap between said grinding wheels in an adjusted position.

3. Apparatus according to claim 1 including an outer guide, one of said adjustable elements including an inner guide rotatable within said outer guide and a member connecting said inner guide and one of said idler pulleys whereby said one idler pulley is rotatable about said outer guide.

4. Apparatus according to claim including a locking screw cooperable between said inner and outer guides to lock said inner guide in an adjustable rotational position relative to said outer guide.

5. Apparatus for forming a hollow-ground knife blade comprising:

a pair of grinding wheels;

a motor for driving the wheels;

a pair of idler pulleys;

a first endless grinding belt disposed about a first idler pulley of said pair thereof and a first wheel of said pair of grinding wheels;

a second endless grinding belt disposed about a second idler pulley of said pair of idler pulleys and a second wheel of said pair of grinding wheels; and an adjustable assembly mounting each said idler pulley for movement of the idler pulleys relative to said grinding wheels to adjust one of an angular relationship of planes passing through the idler pulleys and the grinding wheels and the distance between the idler pulleys and wheels;

said grinding wheels being driven by said motor for rotation about parallel axes and in opposite directions;

said grinding wheels and said belts disposed thereabout defining a gap therebetween for simultaneous bearing engagement of said grinding belts against respective opposite sides of a knife as the knife is passed back and forth in a direction generally parallel to said axes to form a hollow ground knife blade.

6. Apparatus according to claim 5 wherein the adjustable assembly mounts said first idler pulley for movement relative to said first wheel to adjust the angular relationship of planes passing through the first idler pulley and the first wheel to adjust the run of the first grinding belt while enabling said first and second wheels to be maintained in a common plane, the adjustable assembly mounting said second idler pulley for movement relative to said second wheel to adjust the angular relationship of planes passing through the second idler pulley and the second wheel to adjust the run of the second grinding belt while enabling said first and second wheels to be maintained in a common plane.

7. Apparatus according to claim 5 wherein the adjustable assembly mounts said first idler pulley for movement relative to said first wheel to adjust the distance therebetween and thereby adjust the tautness of said first belt about the first wheel and first idler pulley, the adjustment assembly mounting said second idler pulley for movement relative to said second wheel to adjust the distance therebetween and thereby adjust the tautness of said second belt about the second wheel and second idler pulley.

8. Apparatus according to claim 5 including a slide carrying said first grinding wheel and said first idler pulley for movement toward and away from said second wheel and said second idler pulley to adjust the gap between said wheels and a lock for locking said slide in an adjusted position thereby maintaining the gap between said grinding wheels in an adjusted position.

9. Apparatus according to claim 8 wherein said grinding wheels are mounted on a base plate, said slide being mounted on said base plate for sliding movement relative to said base plate.

10. Apparatus according to claim 9 an adjustable element mounting each said idler pulley for angular adjustment of the idler pulleys relative to said grinding wheels to adjust the angular relationship of planes passing through the idler pulleys and the grinding wheels, one of said elements being mounted on said slide for movement therewith.

11. Apparatus according to claim 5 including means for adjusting the gap between said first and second wheels.

12. Apparatus according to claim 5 wherein the adjustable assembly mounts said first idler pulley for movement relative to said first wheel to adjust the angular relationship of planes passing through the first idler pulley and the first wheel to adjust the run of the first grinding belt while enabling said first and second wheels to be maintained in a common plane, the adjustable assembly mounting said second idler pulley for movement relative to said second wheel to adjust the angular relationship of planes passing through the second idler pulley and the second wheel to adjust the run of the second grinding belt while enabling said first and second wheels to be maintained in a common plane, the adjustable assembly mounting said first idler pulley for movement relative to said first wheel to adjust the distance therebetween and thereby adjust the tautness of said first belt about the first wheel and first idler pulley, the adjustment assembly mounting said second idler pulley for movement relative to said second wheel to adjust the distance therebetween and thereby adjust the tautness of said second belt about the second wheel and second idler pulley and means for adjusting the gap between said first and second wheels.

* * * * *